109-37 SR
12/15/87 XR 4,712,393

United States Patent [19]
Deschamps et al.

[11] Patent Number: 4,712,393
[45] Date of Patent: Dec. 15, 1987

[54] METHOD AND DEVICE FOR PERMANENTLY LOCKING A MOVABLE MEMBER IN A FRAMEWORK

[75] Inventors: Daniel Deschamps, Montigny Le Breton-Neux; René Puntous, Toulouse, both of France

[73] Assignees: Fichet Bauche; Davey Bickford Smith & Cie.

[21] Appl. No.: 829,137

[22] PCT Filed: May 24, 1985

[86] PCT No.: PCT/FR85/00129

§ 371 Date: Jan. 16, 1986

§ 102(e) Date: Jan. 16, 1986

[87] PCT Pub. No.: WO85/05651

PCT Pub. Date: Dec. 19, 1985

[30] Foreign Application Priority Data

May 25, 1984 [FR] France ..... 8408272
Jul. 12, 1984 [FR] France ..... 8411115

[51] Int. Cl.[4] ..... E05G 1/04; E05B 63/00
[52] U.S. Cl. ..... 70/1.5; 109/36; 109/37
[58] Field of Search ..... 70/1.5; 109/36, 37, 109/64

[56] References Cited

U.S. PATENT DOCUMENTS

| | | | |
|---|---|---|---|
| 117,899 | 8/1871 | Lillie | 109/37 |
| 118,830 | 9/1871 | Tousley | 109/36 |
| 469,971 | 3/1892 | Martin | 109/37 |
| 1,056,016 | 3/1913 | Fish | 70/1.5 |
| 1,164,488 | 12/1915 | Fink | 70/1.5 |
| 1,716,914 | 6/1929 | Best | 70/1.5 |
| 1,850,337 | 3/1932 | Young . | |
| 4,245,567 | 1/1981 | Herrmann | 70/1.5 |
| 4,266,488 | 5/1981 | Markham | 70/1.5 |

FOREIGN PATENT DOCUMENTS

| | | | |
|---|---|---|---|
| 1602436 | 10/1970 | Fed. Rep. of Germany . | |
| 2821281 | 11/1978 | Fed. Rep. of Germany | 109/37 |
| 2368598 | 5/1978 | France | 109/37 |
| 25911 | 11/1908 | Sweden | 109/36 |

*Primary Examiner*—William F. Pate, III
*Assistant Examiner*—Michael Safavi
*Attorney, Agent, or Firm*—Steinberg & Raskin

[57] ABSTRACT

Method and device for permanently locking a movable member in a framework, such as locking a door of a safe in case of an attack, in which an explosive member sensitive to an outer action is detonated and deforms the movable member such as a door of the safe to create an artifical bolt extending outside of the movable member and penetrating in the framework, e.g. of the safe. The movable member is thus automatically locked when the artificial bolt is created under the effect of the explosion. Alternatively, the explosive member may be provided in the framework itself, in which case the framework is deformed due to the effect of the explosion, creating an artificial bolt which extends into the movable member itself, e.g. the door of a safe.

17 Claims, 4 Drawing Figures

METHOD AND DEVICE FOR PERMANENTLY LOCKING A MOVABLE MEMBER IN A FRAMEWORK

BACKGROUND OF THE INVENTION

The present invention relates to the field of safety and of the fight against or prevention of theft, aggression or breach of close and burglary. Its subject matter is a method of and a device for the permanent self-acting bolting or locking of a movable member in a supporting framework or like structure, said device being tripped or set into operation in case of breach of close or assault. The invention is mainly applicable in safes and strong-boxes or strong-rooms and safety-vaults.

In the following, the invention will be mainly illustrated by setting forth the technical problem to be solved in the case of its preferred application, mainly the relocking of safes and strong-boxes or of strong-rooms and safety vaults upon an attempt at breaking the same open.

The doors of safes or of strong-rooms are generally armoured on the inside and on the outside by means of several millimetres thick steel sheets. The space left between both metal sheets may be filled with steel elements of various shapes embedded in concrete. Such an assembly provides an effective protection against the flame of a cutting torch or against an attack with a hammer-drill or a rotary drill or borer.

To provide against the attacks, there has already been provided automatic locking or bolting systems which would lock all the closing lock-bolts or latches with the assistance of means such as dogs, keeps or stops. The dogs are moved by a complicated and expensive mechanical control system. For instance, for a small safe the volume of which is of 500 $cm^3$, there may be four lock-bolts on each vertical standard, upright or post and two lock-bolts on each horizontal line. The locking arrangement may comprise two sliding dogs co-operating with both pairs of vertical lock-bolts, respectively, and a dog acting upon the pair of upper horizontal lock-bolts as well as another dog acting upon the pair of lower horizontal lock-bolts.

The approach made to the locking problem has not been satisfactory heretofore because the mechanical operating systems are complicated and costly.

In the art of safe and strong-box constructions have already been used so-called 'detector' means which, when the safe is attacked, are likely to operate a movable element which would relock the safe to closed position by acting for instance upon the lock mechanism.

Thus are already known detector means consisting of a simple wire connected to a spring-biased finger and which when it is broken under the effect of the attack would release or free the finger which thus would relock the safe.

Such detector means, however, are not always satisfactory to the extent where the burglars may cut out not only the lock-bolts of the safe but also the movable finger of the detector so that the present systems for relocking in case of attack do eventually not really secure a final locking of the safe in the closed condition.

The U.S. Pat. No. 1,850,337 discloses a safety device applicable to a safe door. In case of an attempt at violation, a gas-controlled triggering system would operate catch pins or lugs effective to set in or fix the door. The gas is preferably the same as the one conventionally used with incapacitating or disabling effects. This old patent (1930) describes a closure system with locks working under the action of a gas under pressure and under a mechanical control. Such a system allows only for a provisional increase in safety because it would still be possible to cause the lock or locks to move back into the initial position. The U.S. Pat. No. 1,850,337 does not provide for a final and permanent locking. Moreover, the detection means are not appropriate to provide for an other than mechanical control of the system.

SUMMARY OF THE INVENTION

The object of the invention is to cope with the inconveniences found in the prior art by providing final and simple closing and locking means which would secure a final and permanent locking and which in particular would make practically impossible the opening of a safe undergoing any attack.

In its general aspect, the invention relates to a process of automatically locking a movable member in a supporting framework or like construction, said process being characterized by the steps of disposing in said member means sensitive to an outer action, engaging said means by a pyrotechnical firing package acting through explosion on at least one outer part of said member which would be deformed under the effect of the explosion and arranging or fitting up that portion of the supporting framework which is located in front of or opposite to this outer part to allow for the setting in or fixing of the latter into the supporting framework once it has been deformed by the explosion.

The invention is also directed to a device for carrying out the aforesaid process, said device comprising a supporting framework and a movable member therein as well as means for locking said member on the supporting framework, said device being characterized in that said locking means comprise means disposed in said movable member and sensitive to an outer action, a pyrotechnical firing package urged by said means in case of an outer action thereupon and acting through explosion upon at least one outer part of said member which would be deformed under the effect of the explosion, that portion of the supporting framework which is lcoated in front of or opposite to this outer part being arranged to enable the latter to be set in or fixed into the supporting framework once it has been deformed by the explosion.

In the foregoing has been stated that, according to one of the essential characterizing features of the invention, the deformation obtained through the explosion of the part of the movable member would provide for permanent and final setting-in and locking of this member within the framework. It should be pointed out that such a deformation may develop until failure or breakage of the area involved of the movable member. Furthermore, also within the scope of the invention is a mutual arrangement according to which it is the framework which would be deformed (or at least partially broken) to lock the movable member.

Also alternatively the means sensitive to an outer action may be provided onto the framework as well as onto the movable member.

As already mentioned hereinabove, the preferred embodiment of the invention consists in its being applied to the locking and closing of armoured doors of safes or strong-rooms. The invention may however be used for locking any movable member whatsoever within the supporting framework since this movable member and this supporting framework exhibit in confronting relationship portions capable of being permanently deformed under the effect of an explosion or burst. This is the case in particular with all the closure systems comprising thick walls bounded by steel sheets deformable through explosion.

The invention substitutes for the mechanical means of the prior art means relying upon or calling for pyrotechnical packages capable of initiating an explosion. In the case of a safe or a strong-room, there is thus provided a final closure of the door so that even the holder of the key and of the cipher combination may not open same any more. The only way left is then the breach of close but same is then substantially delayed.

The means sensitive or responsive to an outer action the movable member is fitted with, in particular the door of the safe or strong-room, may be carried out, on condition of accomplishing a double function, namely the detection of a breach of close, i.e. of a non-voluntary action on the movable member and, on the other hand, of acting onto the pyrotechnical firing package capable of initiating the desired explosion. For the purposes of the present invention, it is preferable to use pyrotechnical means, for instance an ignitable and/or explosive product sensitive to the impact and/or the friction of an attacking tool or to the flame of a torch. Such a layer may be carried advantageously out as a flat foil or sheet embedded within the framework and/or the movable member, for instance interposed between both concrete layers of the wall forming the door of the safe or of the strong-room.

Although such pyrotechnical means are preferred, it is also possible to use other means sensitive or responsive to an outer breaking action. It should be pointed out that the pyrotechnical means form the best power storage or accumulator thereby permitting to dispense with an outer energy source as would be the case with detecting means using electric power. It would however be also possible to make use of other kinds of storages or accumulators, for instance a tank under vacuum or under pressure which upon being pierced through would initiate a mechanical energizing of the burster detonator triggering the explosion. Another example would be a spring kept under tension by a glass plate or by a wire.

According to the invention, there is provided in cooperation with said means sensitive to an outer action a pyrotechnical firing package capable of initiating an explosion or burst. Such a package comprises in a known manner by way of illustration at least one detonator and some quickmatch or detonating-fuse. Under the effect of the explosion, at least one outer part of the movable member or of the framework would be deformed. The explosion would provide a stretching or failure or break of the component wall of the movable member or framework, for instance of the steel sheet of the armoured door of a safe or of a strong-room.

In order to provide the locking effect sought, the supporting framework surrounding the movable member is so shaped that the outer part thus deformed may set itself in so as to perform the final locking. In the case of a frame of the door of a safe or strong-room, such a frame may be formed with a groove into which the steel wall of the door would be caused to set. In this latter case is thus carried out a continuous locking of the door within its frame which would render it unattackable otherwise than with a torch.

In the prior art is already known the general method of tube-expanding which involves the deformation of a tube through explosion to secure same into adjacent walls. The present invention preferably implies a combination of pyrotechnical detection and explosion means to provide a safety system. No teaching of this kind may be found in the general documents or the patent literature relating to tube-expansion.

The invention in its preferred application is directed to a method of relocking a safe or the like, characterized in that when this safe undergoes an aggression, at least one portion of the safe door is automatically deformed and upset or forced in or reversely to thereby create at least one artificial bolt preventing or substantially delaying the opening of this safe.

According to another characterizing feature of this method, said artificial bolt extends or moves into a recess or housing provided in the wall in front of or opposite to that giving rise to said bolt.

As stated previously, the deformation and upsetting or forcing in of material producing said artifical bolt are produced by a small explosion or suitable pyrotechnical means.

A device for carrying out the above method, of the type comprising a detector means associated with a safe and likely to operate under the effect of an aggression to relock the safe is characterized in that said detector means consists of a small body of explosive accommodated or housed within at least one portion of the door of the safe preferably near the edge of this door.

This device is further characterized by at least one recess arranged in front of or opposite to the small body of explosive within the wall of the safe in front of the edge of the door.

According to a particular embodiment, the small body of explosive is accommodated within an inserted piece made inside fast of the door or of the lock mechanism and is preferably located within a hollow portion provided in a plate or the like forming part of said piece.

The aforesaid detector means may be completed with another small mass of explosive associated with the lock plate or case and/or with at least one of the bolts of the lock of the safe.

The invention is still further directed to a safe or strong-box of any type fitted with a device according to any one of the characterizing features mentioned hereinabove.

BRIEF DESCRIPTION OF THE DRAWINGS

The invention will be better understood and further objects, characterizing features, details and advantages thereof will become apparent in the following explanatory description thereof with reference to the accompanying diagrammatic drawings given by way of non-limiting example only illustrating a presently preferred specific embodiment of the invention and wherein.

DESCRIPTION OF THE PREFERRED EMBODIMENTS

Figure 1:
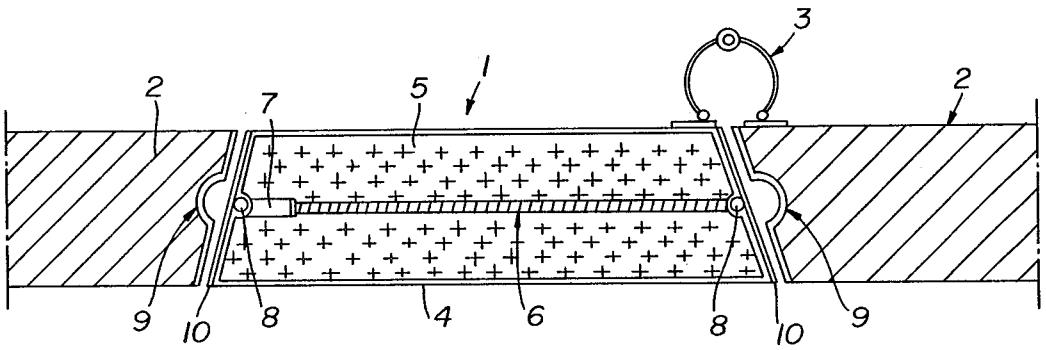
FIG. 1 diagrammatically shows in section a wall of a safe or strong-room provided with a door and fitted with locking means according to the invention.

FIG. 1 shows a door 1 of a safe which is movable within a frame 2 by means of a hinge 3. The inside of the strong-room or safe is towards the hinge 3 and the outside towards the opposite side, i.e. at the bottom portion of FIG. 1. As known, the door 1 diagrammatically comprises steel sheets 4 inside of which is arranged concrete 5.

According to the invention, there is provided within the door 1 and embedded between the concrete layer a pyrotechnical breach detecting layer 6. By way of example, it may consist of a layer of ignitable compound of a few tenths of millimetre thickness consisting of black gun-powder or of an equivalent product, sensitive to heating (for instance up to temperatures of 200° C. or more). It is also possible to use one or several layers of ignitable and/or explosive product of the kind sensitive to shocks, for instance a penthrite-based explosive paint or to the rubbing or friction of a tool or also the flame of a torch. In some cases, it may be advantageous to make use of multiple layers of different pyrotechnical products, i.e. capable of responding to various outer actions. For instance, it is possible to associate a layer of penthrite with a layer of known ignitable powder as delay powder such as a layer of red lead oxide-silicon. The common function of all these means is to be sensitive to an outer breaking action.

The layer 6 co-operates with a pyrotechnical firing package acting through explosion or burst. In the example chosen and shown on FIG. 1 of the accompanying drawings, there is seen a detonator 7 which may consist of a few decigrams of penthrite primed by one decigram of lead nitride. This detonator is connected with the layer 6 on the one hand and with detonating quickmatches or fuses 8 on the other hand. The detonating fuses 8 are embedded in the vicinity of the outer steel sheet of the door. These detonating fuses are for instance detonating fuses loaded with penthrite at the rate of 20 g/m.

In front of the detonating fuses 8, but towards the frame 2 are provided grooves 9.

Upon a breach at any point whatsoever of the protected wall, the layer 6 is put into operation and the firing is propagated through the agency of the detonator 7 to the detonating fuses 8. The ignition is performed almost instantaneously. The detonation of the detonating fuses 8 is effective in swelling or bulging the steel wall 10 of the door 1 which is caused to be set or fixed into the groove 9 formed in the frame 2. Thus is performed a locking of the door 1 within the frame 2.

Figure 2:
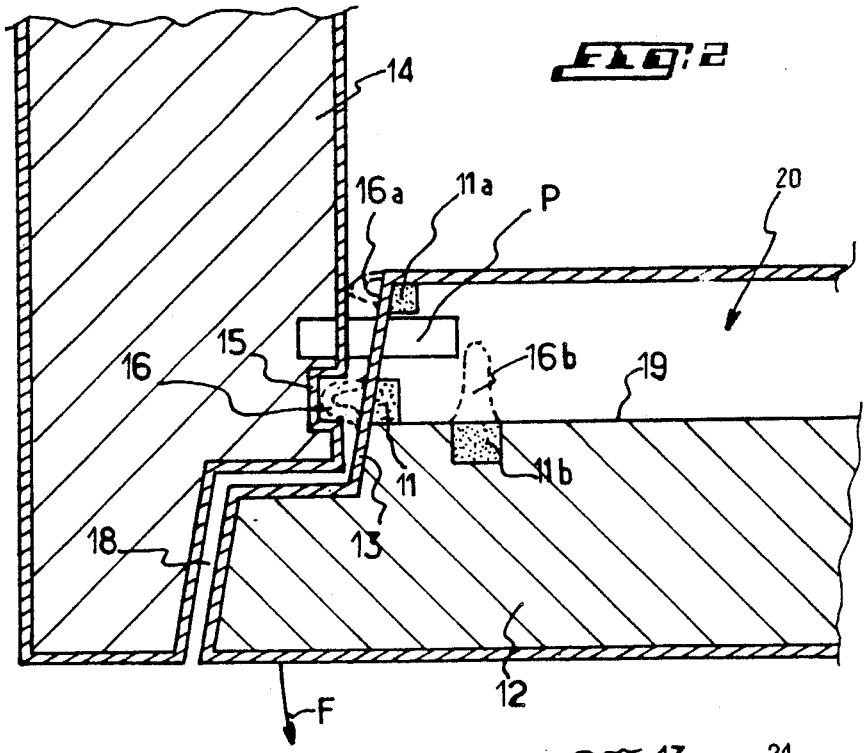
FIG. 2 is a partial view in horizontal cross-section of a safe fitted with a device according to the invention.

Referring to FIG. 2, a device for relocking a safe according to the invention consists essentially of a small body of explosive or of any pyrotechnical means 11 accommodated or housed within the door 12 of the safe and preferably located near the edge 13 of this door.

In the wall 14 in front of the edge 13 of the door 12 is formed a recess 15 in front of the small body of explosive 11.

Figure 3:
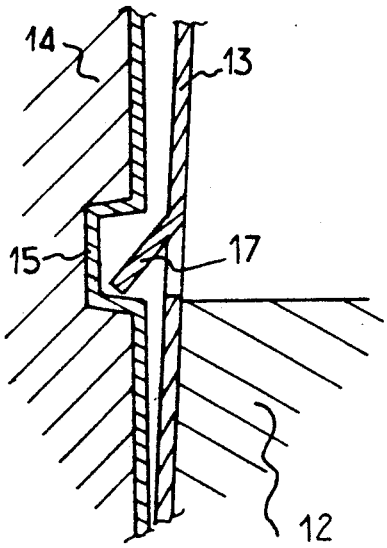
FIG. 3 is a fragmentary sectional view drawn on a larger scale of one of the walls of the safe and of the door associated with this wall, said view illustrating a particular operation of the device according to the invention.

Thus, upon an attempt at breach of close, the explosive 11 which would directly or indirectly sense the aggression would produce a deflagration deforming and locally upsetting or forcing in the edge 13 of the door 12 towards the recess 15 as shown at 16 so as to carry out the relocking of the safe. Although not shown on FIG. 2, there may be provided any means whatsoever connected to the explosive 11 to initiate the ignition of this explosive. It is quite possible without leaving the scope of the invention to provide an arrangement reverse of that shown on FIG. 2, i.e. the explosive 11 would be housed within the wall 14 and the recess 15 would be provided in the edge 13 of the door 12. It is also possible to provide several bodies of explosive such as 11 distributed inside and onto the periphery of the door 12 as well as several recesses such as 15 in corresponding or registering relationship with all such explosives and formed within the walls of the safe at their portions adjacent to the periphery of the door 12. The deformation of the edge 13 of the door may result in a bulge or buckling of this edge as shown at 16 or in a deformation or a tearing of this edge as shown at 17 on FIG. 3. In this latter case, it is seen that the torn out portion 17 extends into the recess 15 so as to provide one or several sharp edges which would lock the door 12 to prevent opening thereof.

The recess or recesses 15 may be omitted in the case where the door 12 forms together with the walls 14 of the safe a baffle-shaped fillister or rabbet 18 as well seen on FIG. 2. Indeed, if the explosive is disposed at 11*a* within one of the inside corners of the door 12, this explosive will be able to deform the edge 13 of the door as shown at 16*a* and although there is no recess in front of the explosive 11*a* within the wall 14, this would be adequate to prevent the swinging of the door 12 in the direction of the arrow F.

In addition to the explosive 11 and/or 11*a*, it is possible to provide another small body of explosive 11*b* at the lock plate or back plate 19 of the door 12 which carries the lock mechanism not shown, housed in the space 20. Thus, the action of the explosive 11*b* would produce a local deformation of the lock plate 19 as shown at 16*b*. This deformation 16*b* could for instance lock the rear portion of a bolt P of the lock, which bolt would thus be unable to retract from or move away of the wall 14. It could also be possible without leaving the scope of the invention to provide a small body of explosive inside of at least one bolt such as P, which explosive under the effect of an aggression could deform or tear the bolt within its bolt-clasp or like lock keeper, catch or box-staple to thereby reinforce or enhance the locking of the safe in the closed position.

Figure 4:
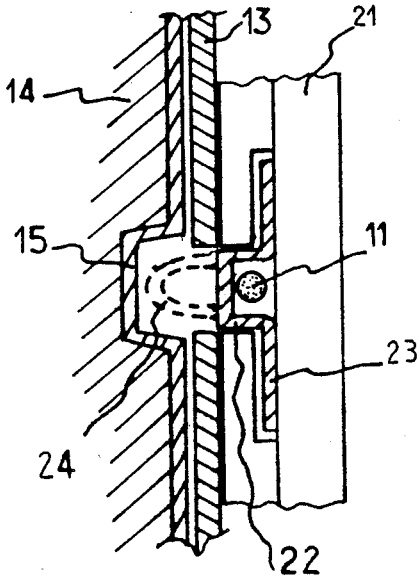
FIG. 4 is a partial sectional view of a piece inserted onto the door of the safe and containing a small body of explosive.

According to an alternative embodiment shown on FIG. 4, the explosive 11 is accommodated within a piece 21 inserted in and made fast of the edge 13 of the door 12 within said door. More specifically, the explosive 11 is located in a recess or hollow space 22 provided in a plate or metal sheet 23 rigidly connected to the piece 21. Thus, the explosive 11 would produce the deformation seen at 24 and forming as previously an artificial bolt extending into the inside of the recess 15 formed in the casing of the safe embodied here as the wall 14.

Therefore, according to the invention, there has been provided a system for relocking a safe by means of a simple upsetting or forcing in of the material which may be positioned either at the door of the safe or at the casing or the walls of this safe or even at the locking appliance.

It should be understood that the invention is not at all limited to the embodiments described and shown which have been given by way of examples only.

It could thus be quite possible to provide any means other than an explosive or a pyrotechnical system for producing the deformation and the upsetting or forcing in of the material.

What we claim is:

1. A safe, comprising a door having front and back panels and a side edge surface extending between said front and back panels in a thickness direction of said door, and a framework upon which said dooor is movably mounted, with said side edge surface being contiguous with said framework when said door is closed, and explosive means situated within said door between said front and back panels thereof and adjacent said side edge surface, for exploding under the effect of an attack and for deforming said side edge surface adjacent thereto, to create therein at least one artificial bolt extending towards and into said framework.

2. The safe of claim 1, wherein said explosive means comprise at least one detonator, a detonating fuse accommodated within said door near the edge surface thereof, and at least one layer of ignitable or explosive product adapted to detect an attack and connected to said detonator and detonating fuse.

3. The safe of claim 1, wherein said framework comprises at least one recess adjacent said side edge surface of the door when said door is closed, and adapted to receive said artificial bolt therein.

4. The safe of claim 1, additionally comprising a plate made fast with said edge surface of said door and including a hollow space containing said explosive means.

5. The safe of claim 1, wherein said door comprises a lock plate and said explosive means are associated with said lock plate.

6. The safe of claim 2, wherein said layer is embedded in said door between said front and back panels thereof.

7. The safe of claim 1, wherein said edge surface of said door is adapted to bulge or buckle to form said artificial bolt.

8. The safe of claim 1, wherein said edge surface of said door is adapted to tear and extend to form said artifical bolt.

9. The safe of claim 1, wherein said edge surface of said door forms a baffle-shaped fillister or rabbet with said framework when said door is closed.

10. The safe of claim 1, wherein said door comprises at least one bolt and said explosive means are additionally situated inside thereof.

11. The safe of claim 1, wherein said door comprises a back or lock plate carrying locking means for said door in a space between said plate and said rear panel of said door, with said explosive means additionally situated to deform said plate, such deformation locking a bolt of said locking means in position.

12. The safe of claim 1, wherein said explosive means are constituted by pyrotechnic means.

13. The safe of claim 1, wherein said explosive means include a detonatable fuse, and means for detecting an attack and detonating said fuse.

14. The safe of claim 13, wherein said detecting means include means for propagating detection of the attack to said detonatable fuse.

15. The safe of claim 1, wherein said side edge surface of said door is in the form of a steel sheet.

16. The safe of claim 2, wherein said front and back panels and said side edge surface of said door are each in the form of a metallic sheet, and said door comprises a concrete interior extending between said front and back panels in the thickness direction thereof, with said detecting layer embedded in said concrete.

17. The safe of claim 2, wherein said detecting layer extends across an interior of said door in a direction substantially perpendicular to the thickness direction thereof.

* * * * *

UNITED STATES PATENT AND TRADEMARK OFFICE

CERTIFICATE OF CORRECTION

PATENT NO. : 4,712,393

DATED : December 15, 1987

INVENTOR(S) : Daniel Deschamps, et al.

It is certified that error appears in the above—identified patent and that said Letters Patent is hereby corrected as shown below: On the title page:

(73) assignees: FICHET-BAUCHE; Davey Bickford Smith & Cie. et Societe de Produits Chimiques.

Signed and Sealed this

Eighteenth Day of December, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,712,393

DATED : December 15, 1987

INVENTOR(S) : Daniel Deschamps, et al.

It is certified that error appears in the above-identified patent and that said Letters Patent is hereby corrected as shown below:

On the title page:
[73] Assignee: should read as follows:

--Fichet Bauche; ETS Davey Bickford Smith & CIE ET Societe Anonyme D'Explosifs ET DE Produits Chimiques, France--

This certificate supersedes Certificate of Correction issued December 18, 1990.

Signed and Sealed this

Thirtieth Day of July, 1991

*Attest:*

HARRY F. MANBECK, JR.

*Attesting Officer*

*Commissioner of Patents and Trademarks*